United States Patent [19]

Terada et al.

[11] 4,014,190

[45] Mar. 29, 1977

[54] WARP KNITTED FOUNDATION FOR SLIDING CLASP FASTENERS

[75] Inventors: Fumio Terada; Yoshio Matsuda; Yoshiharu Yamaguchi, all of Uozu, Japan

[73] Assignee: Yoshida Kogyo Kabushiki Kaisha, Japan

[22] Filed: Oct. 1, 1973

[21] Appl. No.: 402,379

Related U.S. Application Data

[62] Division of Ser. No. 202,083, Nov. 26, 1971, Pat. No. 3,848,556.

[30] Foreign Application Priority Data

Dec. 4, 1970 Japan ..... 45-108006
Dec. 4, 1970 Japan ..... 45-108007

[52] U.S. Cl. ..... 66/195
[51] Int. Cl.[2] ..... D04B 21/16
[58] Field of Search ..... 2/266; 24/205.16 C; 28/76 T, 72 CS, 77; 66/193, 195; 112/103, 265

[56] References Cited

UNITED STATES PATENTS

| | | | |
|---|---|---|---|
| 2,380,939 | 8/1945 | Campbell | 28/72 CS UX |
| 2,433,279 | 12/1947 | Johnson | 66/195 X |
| 2,535,376 | 12/1950 | Thompson, Jr. | 66/195 UX |
| 3,685,474 | 8/1972 | Frolich et al. | 66/195 UX |
| 3,757,541 | 9/1973 | Frolich et al. | 66/193 |
| 3,762,002 | 10/1973 | Frolich et al. | 66/195 X |

*Primary Examiner*—Robert R. Mackey
*Attorney, Agent, or Firm*—Robert E. Burns; Emmanuel J. Lobato; Bruce L. Adams

[57] ABSTRACT

A warp-knitted fabric having a plurality of seams disposed at predetermined intervals in a transverse direction of the fabric and extending longitudinally of the fabric. Water-soluble fibers or threads soluble at a first temperature join alternate ones of the seams and water-soluble fibers or threads soluble at a second temperature higher than the first temperature join the remaining seams. The water-soluble fibers or threads may be of polyvinyl alcohol.

7 Claims, 8 Drawing Figures

WARP KNITTED FOUNDATION FOR SLIDING CLASP FASTENERS

This is a division of application Ser. No. 202,083, filed Nov. 26, 1971, now U.S. Pat. No. 3,848,556, granted Nov. 19, 1974.

This invention relates to a method of producing a sliding clasp fastener comprising carrier tapes of a knitted structure, and is more particularly directed to the method in which a double row of inter-engaged fastener elements is applied to a warp-knitted tape.

Known methods of this description include bringing two carrier tapes closely together in edge-to-edge abutting relation and laying two inter-engaged element rows on the tapes for sewing longitudinally along their abutted edges. However, there are always encountered some irregularities in the movement of carrier tapes while in transit from the supply roll to the sewing machine and such irregularities are due to irregular rotation of the roll, frictional resistance of the tape guides and other various operating reasons. This would often result in irregularities in the pitch of fastener elements sewn on the tapes. Therefore, with such prior-art methods it is difficult to obtain slide fasteners of the desired product quality.

Whereas, it is the primary object of this invention to provide an improved method which permits the production of high-quality sliding clasp fasteners and which will substantially eliminate the above difficulties of prior-art methods.

It is a more specific object of the invention to provide a method of applying two inter-engaged rows of fastener elements onto warp-knitted carrier types with sufficient dimensional stability to ensure uniform pitch of the elements when sewn on the tapes. The invention further includes a carrier tape of warp-knitted structure for supporting rows of fastener elements.

These and other objects and features of the invention will appear clear from the detail description which follows with reference to the accompanying drawings in which.

According to the present invention, there is provided a method for producing a sliding clasp fastener comprised of a double carrier tape provided with a water-soluble seam extending longitudinally and centrally thereof, which method essentially comprises the steps of:

a. sewing two inter-engaged rows of fastener elements on the double carrier tape with coupling head portions of said elements held in alignment with the seam;

b. dissolving this seam and thus separating the double carrier tape into identical halves along the said seam; and c. applying a slider and end stops on the thus separated stringer tapes, and cutting the tapes to a desired product length.

Figure 1:
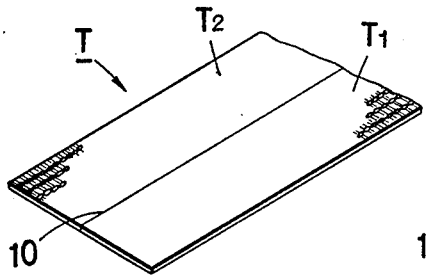
FIG. 1 is a perspective view of a warp-knitted carrier tape for attaching fastener elements thereon according to the invention.
Figure 5:
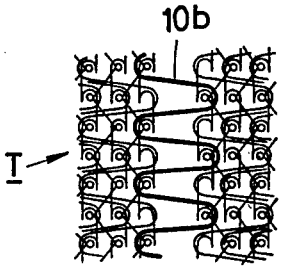
FIG. 5 is a diagrammatic view on enlarged scale of a knit pattern of a portion of the carrier tape embodying the invention.

Referring now to the drawings and FIG. 1 in particular, there is shown a double carrier tape T made of a warp-knitted fabric and provided with a seam 10 of a water-soluble synthetic fiber such as of polyvinyl alcohol. The seam 10 extends longitudinally and centrally of the carrier tape T and defines a separation line along which the tape is split into identical halves $T_1$ and $T_2$ in the manner hereinafter described. There is provided a weft thread 10b of any synthetic fiber which is soluble in contact with water, as shown in FIG. 5, and which constitutes the above-mentioned seam 10.

Figure 2:
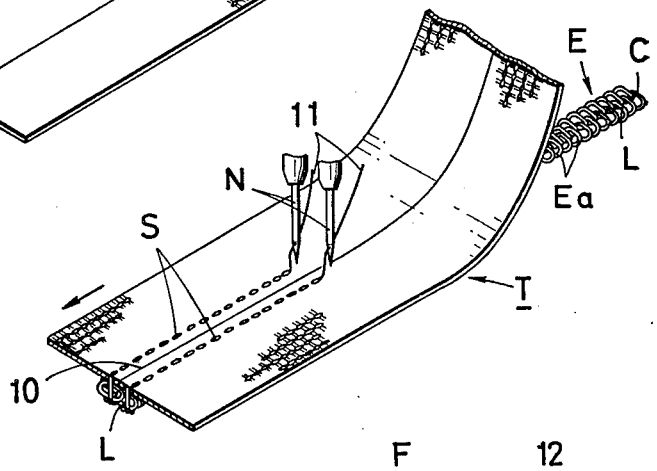
FIG. 2 is a perspective view of the tape to which two inter-engaged rows of elements are being sewn.

A double row of elements, i.e. two rows E of fastener elements which have been previously inter-engaged, is applied on the carrier tape T with coupling head portions C of the engaged elements Ea held in alignment with the seam 10 and is thus sewn closely therealong with needles N carrying sewing threads 11 and extending from a sewing machine (not shown) in the manner illustrated in FIG. 2. More specifically, the two inter-engaged rows of elements are sewn onto the tape T with two parallel lines of stitching S running over leg portions L of the elements and extending in parallel with and on opposite sides of the seam 10.

Figure 3:
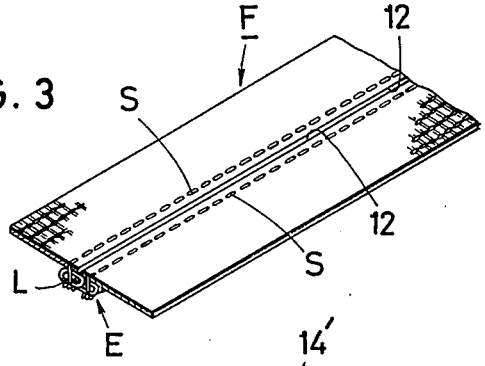
FIG. 3 is a perspective view of the tape carrying elements thereon and separated into two opposite stringers.

The double carrier tape T having inter-engaged rows of elements thus sewn thereon is now immersed in water, for example warm water, chemical liquids or the like, whereupon the seam 10 is dissolved so as to separate the tape into identical stringer halves $T_1$, $T_2$ now having opposed edges 12 along which the rows of elements are secured, as shown in FIG. 3. The seam 10 may be conveniently dissolved by immersing the tape T in a dyeing bath or cleaning water bath usually provided in a fastener making factory.

Figure 4:
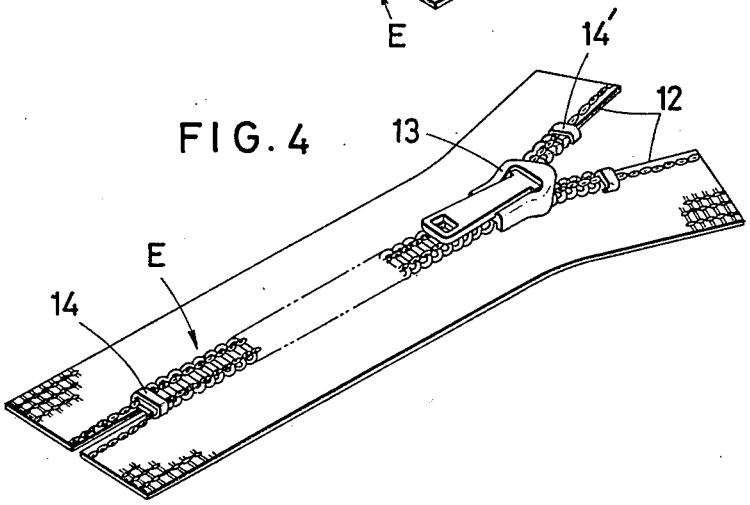
FIG. 4 is a perspective view of a sliding clasp fastener finished in accordance with the invention.

The resulting fastener chain F is now applied with sliders 13 and end stops 14, 14' respectively, at predetermined intervals and cut to a desired product length as illustrated in FIG. 4.

Figure 6:
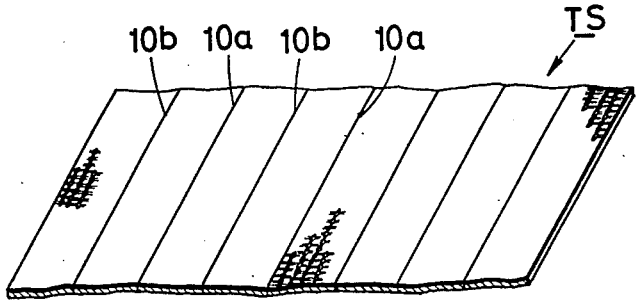
FIG. 6 is a perspective view of a fabric of increased width embodying the invention.
Figure 7:
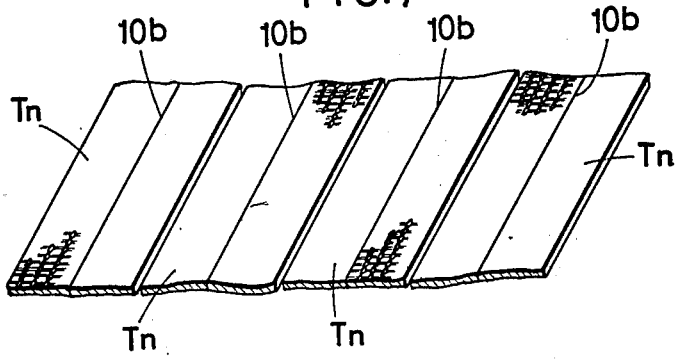
FIG. 7 is a view similar to FIG. 6 but showing the fabric separated widthwise into a plurality of pairs of joined carrier tapes of a desired product width similar to the tape shown in FIG. 1.
Figure 8:
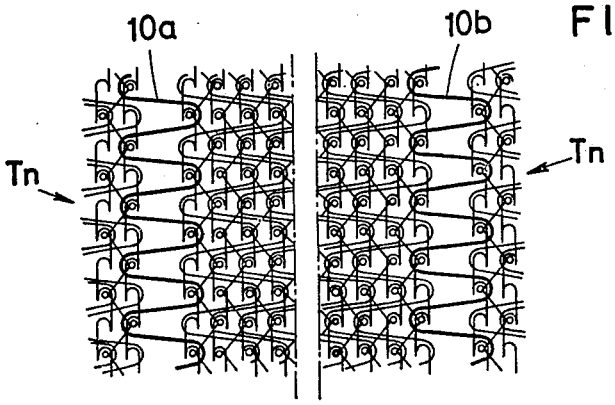
FIG. 8 is a diagrammatic view on enlarged scale of a knit pattern of a segment of the fabric shown in FIG. 6.

Reference to FIGS. 6, 7 and 8, inclusive, shows a modification of the carrier tape embodying the invention. As shown in FIG. 6, there is provided a relatively wide tape of fabric TS of warp-knitted fabric section which is provided lengthwise with a plurality of alternate first and second groups of water-soluble seams 10 which are dissolvable at two different temperatures. A suitable synthetic fiber may be treated so that it becomes water-soluble at a temperature of say about 65° C for use as a first group of low-temperature soluble seams **10*a*. Similarly, a second group of high-temperature seams 10*b* may be formed by a synthetic fiber which is water-soluble at about 90° C. These groups of seams alternate at predetermined intervals on the tape TS, and the first group 10*a*** defines a plurality of separation lines along which the wide tape is first separated into sections T*n* by immersion in water at about 65° C, each of which comprises a pair of joined elongated fabric webs of tapes T, similar to that which is shown in FIG. 1. Each tape section T*n* contains the second seam 10*b* which defines a separation line along which the inter-engaged rows of elements are secured to the tape in the manner previously described. Thereafter, the double carrier tape T carrying the inter-engaged element rows is further immersed in water at 90° C thereby dissolving the second seam 10*b* and separating the tape into identical halves as above described.

It will be thus understood that the rate of production of fastener tapes of this character and hence complete product fasteners is remarkably increased and that fastener elements can be mounted on the tapes without encountering objectionable irregularities in the element pitch.

What is claimed is:

1. A farbic having a warp-knitted structure including a plurality of seams joined by a plurality of water-soluble synthetic fibers disposed in a transverse direction of the fabric at predetermined intervals and extending longitudinally of the fabric, said plurality of water-soluble synthetic fibers comprising first fibers soluble at a first temperature and second fibers soluble at a second temperature higher than the first temperature, ones of said first and said second fibers being alternately disposed in a transverse direction of the fabric.

2. A fabric as defined in claim 1 wherein said synthetic fibers polyvinyl alcohol.

3. A fabric as defined in claim 1 wherein said first fibers are soluble at about 65° C and said second fibers are soluble at about 90° C.

4. A composite fabric structure comprising, in combination:

a. a plurality of elongated fabric webs each having a pair of opposed longitudinal edges;

b. a plurality of soluble threads soluble at a first temperature joining pairs of said elongated fabric webs together along adjacent parallel longitudinal edges of said elongated fabric webs; and c. a plurality of soluble threads soluble at a second temperature higher than said first temperature joining said pairs of joined elongated fabric webs together along adjacent parallel longitudinal edges of said pairs of joined elongated fabric webs.

5. In a composite fabric structure according to claim 4 wherein said threads soluble at said first temperature and said threads soluble at said second temperature are water-soluble.

6. In a composite fabric structure according to claim 4 wherein said threads soluble at said first temperature and said threads soluble at said second temperature are made of polyvinyl alcohol.

7. In a composite fabric structure according to claim 4 wherein the first mentioned threads are soluble at about 65° C and the next mentioned threads are soluble at about 90° C.

* * * * *